US008938988B2

(12) United States Patent
Yanik et al.

(10) Patent No.: US 8,938,988 B2
(45) Date of Patent: Jan. 27, 2015

(54) MULTICHANNEL HEAT EXCHANGER WITH DISSIMILAR FLOW

(75) Inventors: Mustafa K. Yanik, York, PA (US); William L. Kopko, Jacobus, PA (US); Jose Ruel Yalung de la Cruz, Dover, PA (US)

(73) Assignee: Johnson Controls Technology Company, Holland, MI (US)

( * ) Notice: Subject to any disclaimer, the term of this patent is extended or adjusted under 35 U.S.C. 154(b) by 101 days.

(21) Appl. No.: 13/541,392

(22) Filed: Jul. 3, 2012

(65) Prior Publication Data

US 2012/0267086 A1 Oct. 25, 2012

Related U.S. Application Data

(63) Continuation of application No. 12/200,471, filed on Aug. 28, 2008, now Pat. No. 8,234,881.

(51) Int. Cl.

| | |
|---|---|
| ***F25B 39/02*** | (2006.01) |
| ***F25B 39/00*** | (2006.01) |
| ***F28D 1/053*** | (2006.01) |
| ***F28F 1/02*** | (2006.01) |
| ***F28F 9/02*** | (2006.01) |

(52) U.S. Cl.

CPC ..... *F25B 39/00* (2013.01); *F28D 1/05383* (2013.01); *F28F 1/022* (2013.01); *F28F 1/025* (2013.01); *F28F 9/0243* (2013.01); *F28F 9/0282* (2013.01); *F28F 2220/00* (2013.01)

USPC ..... 62/515

(58) Field of Classification Search

CPC ..... F28F 1/08; F28F 9/0212; F28F 1/022; F28F 9/0282; F28F 9/0243; F28F 1/025; F28F 2220/00; F28D 1/05383

USPC ..... 62/498, 515, 324.1; 165/153, 174, 151, 165/272

See application file for complete search history.

(56) References Cited

U.S. PATENT DOCUMENTS

| | | | |
|---|---|---|---|
| 3,229,722 | A | 1/1966 | Kritzer |
| 3,603,384 | A | 9/1971 | Hugging et al. |
| 3,636,982 | A | 1/1972 | Drake |

(Continued)

FOREIGN PATENT DOCUMENTS

| | | |
|---|---|---|
| DE | 387330 | 12/1923 |
| DE | 19740114 | 3/1999 |

(Continued)

OTHER PUBLICATIONS

Chinese Office Action and Search Report, Application No. 200910253039.3, issued Aug. 3, 2012.

*Primary Examiner* — Frantz Jules
*Assistant Examiner* — Emmanuel Duke
(74) *Attorney, Agent, or Firm* — Fletcher Yoder, P.C.

(57) ABSTRACT

Heating, ventilation, air conditioning, and refrigeration (HVAC&R) systems and heat exchangers are provided that include multichannel tube configurations designed to promote flow of refrigerant within the multichannel tubes near the edges of the tubes that are contacted first by an external fluid. The tube configurations include flow paths of varying cross-sections, spacings, and sizes. Flow control mechanisms, such as inserts, blocking plates, sleeves, crimped sections, and crushed sections, may be employed with the flow paths to favor flow near the edges of the tubes that are contacted first by an external fluid.

9 Claims, 8 Drawing Sheets

(56) References Cited

U.S. PATENT DOCUMENTS

| | | | | |
|---|---|---|---|---|
| 3,871,407 | A | 3/1975 | Bykov et al. | |
| 4,031,602 | A | 6/1977 | Cunningham et al. | |
| 4,113,006 | A * | 9/1978 | Clapp | 165/76 |
| 4,190,105 | A | 2/1980 | Dankowski | |
| 4,766,953 | A | 8/1988 | Grieb et al. | |
| 5,251,692 | A | 10/1993 | Haussmann | |
| 5,372,188 | A | 12/1994 | Dudley | |
| 5,386,629 | A * | 2/1995 | Ouchi et al. | 29/890.046 |
| 5,586,598 | A | 12/1996 | Tanaka et al. | |
| 5,765,393 | A | 6/1998 | Shlak et al. | |
| 5,797,184 | A | 8/1998 | Tanaka et al. | |
| 5,826,646 | A | 10/1998 | Bae | |
| 5,836,382 | A | 11/1998 | Dingle et al. | |
| 6,000,467 | A * | 12/1999 | Tokizaki et al. | 165/134.1 |
| 6,189,607 | B1 * | 2/2001 | Hosoya et al. | 165/174 |
| 6,343,645 | B1 * | 2/2002 | Baumann et al. | 165/140 |
| 6,467,535 | B1 | 10/2002 | Shembekar et al. | |
| 6,470,964 | B1 * | 10/2002 | Nakado et al. | 165/177 |
| 6,513,582 | B2 | 2/2003 | Krupa et al. | |
| 6,546,998 | B2 * | 4/2003 | Oh et al. | 165/110 |
| 6,932,153 | B2 | 8/2005 | Ko et al. | |
| 6,935,418 | B1 * | 8/2005 | Valaszkai et al. | 165/177 |
| 7,021,370 | B2 | 4/2006 | Papapanu | |
| 7,059,399 | B2 * | 6/2006 | Chin et al. | 165/177 |
| 7,080,683 | B2 | 7/2006 | Bhatti et al. | |
| 7,156,162 | B2 | 1/2007 | Manaka | |
| 7,163,052 | B2 | 1/2007 | Taras et al. | |
| 7,269,966 | B2 * | 9/2007 | Lowenstein et al. | 62/271 |
| 7,398,819 | B2 | 7/2008 | Taras et al. | |
| 7,549,465 | B2 | 6/2009 | Gong et al. | |
| 7,980,094 | B2 | 7/2011 | Yanik et al. | |
| 2003/0131981 | A1 * | 7/2003 | Kohler et al. | 165/178 |
| 2004/0134226 | A1 | 7/2004 | Kraay | |
| 2005/0051318 | A1 * | 3/2005 | Fujita et al. | 165/178 |
| 2005/0241816 | A1 | 11/2005 | Shabtay et al. | |
| 2005/0269069 | A1 | 12/2005 | Hancock | |
| 2006/0096736 | A1 * | 5/2006 | Burkhalter et al. | 165/76 |
| 2006/0101849 | A1 | 5/2006 | Taras et al. | |
| 2007/0079955 | A1 * | 4/2007 | Ghelli et al. | 165/158 |
| 2007/0096611 | A1 * | 5/2007 | Antonijevic et al. | 313/46 |
| 2008/0099191 | A1 | 5/2008 | Taras et al. | |
| 2008/0105420 | A1 * | 5/2008 | Taras et al. | 165/174 |
| 2008/0142203 | A1 * | 6/2008 | Yanik et al. | 165/151 |

FOREIGN PATENT DOCUMENTS

| | | |
|---|---|---|
| EP | 0219974 | 4/1987 |
| EP | 0583851 | 2/1994 |
| EP | 1426714 | 9/2004 |
| JP | 56130595 | 10/1981 |
| JP | 58045495 | 3/1983 |
| JP | 07190661 | 7/1995 |
| JP | 11083371 | 3/1999 |
| WO | WO 02/103270 | 12/2002 |
| WO | WO 2006/083435 | 8/2006 |
| WO | WO 2006/083442 | 8/2006 |
| WO | WO 2006/083450 | 8/2006 |
| WO | 2008/006423 | 1/2008 |

* cited by examiner

FIG. 1
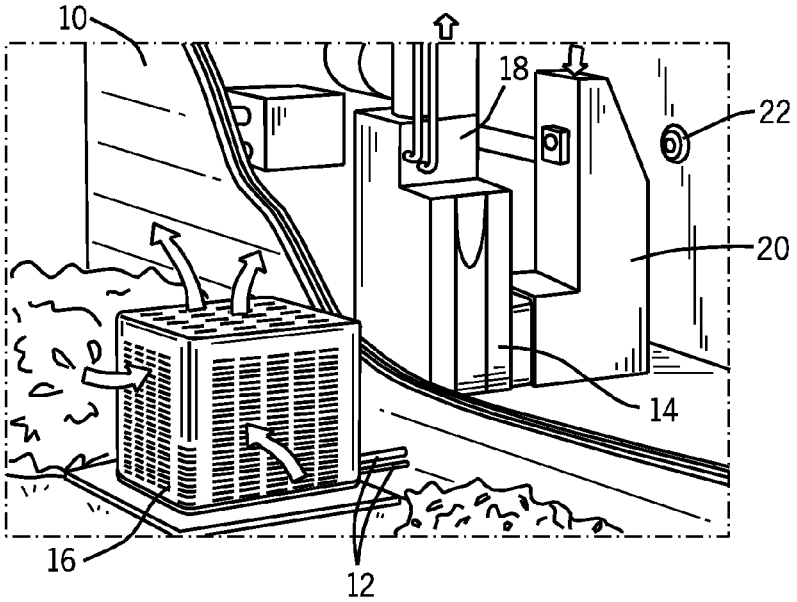
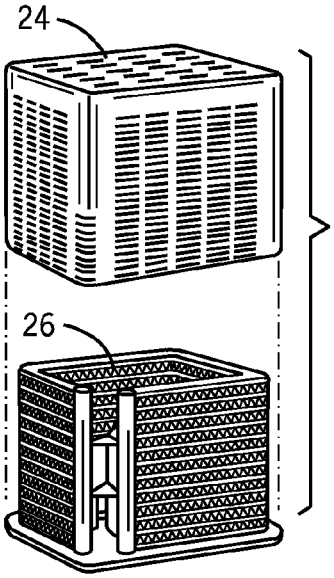
FIG. 2
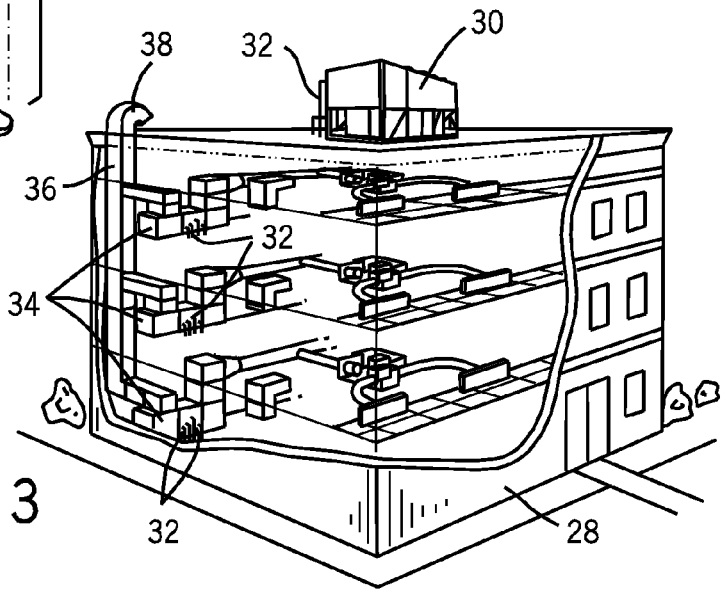
FIG. 3

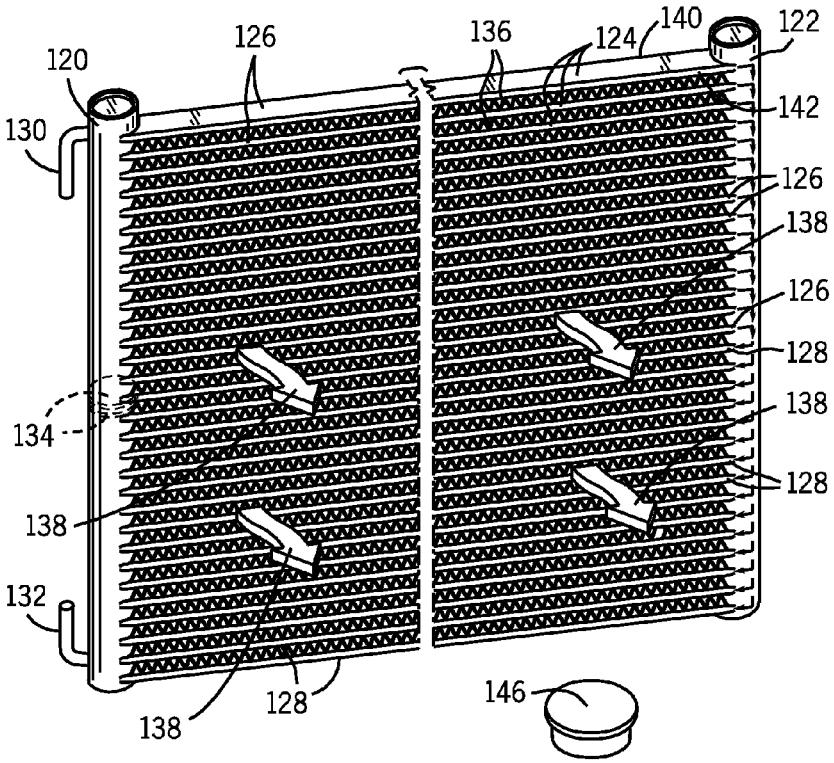
FIG. 6
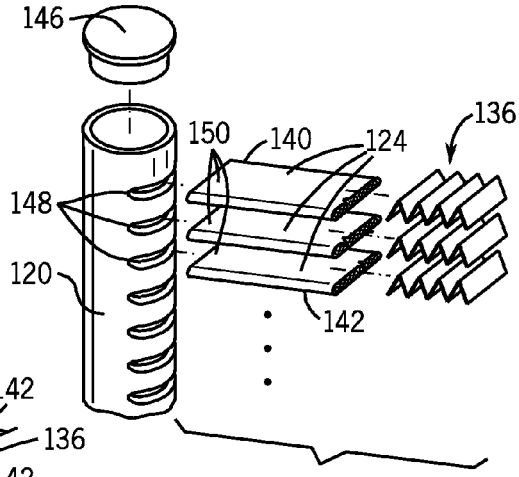
FIG. 8
FIG. 7
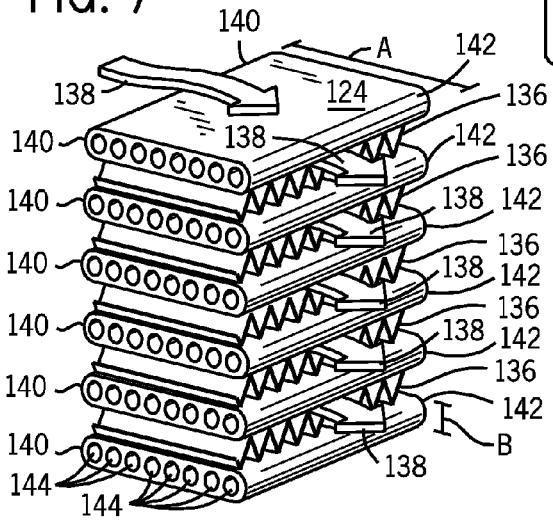

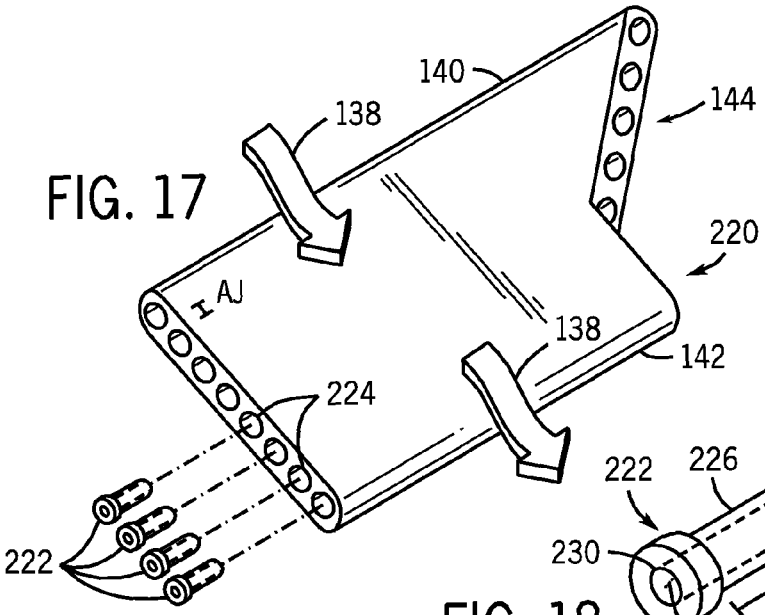
FIG. 17
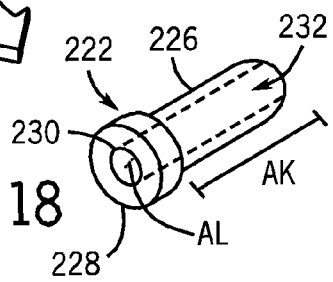
FIG. 18
FIG. 19
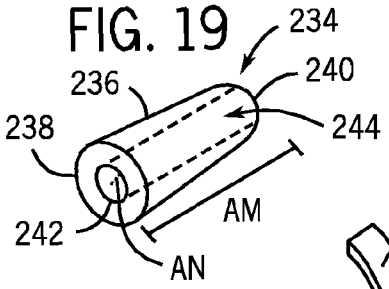
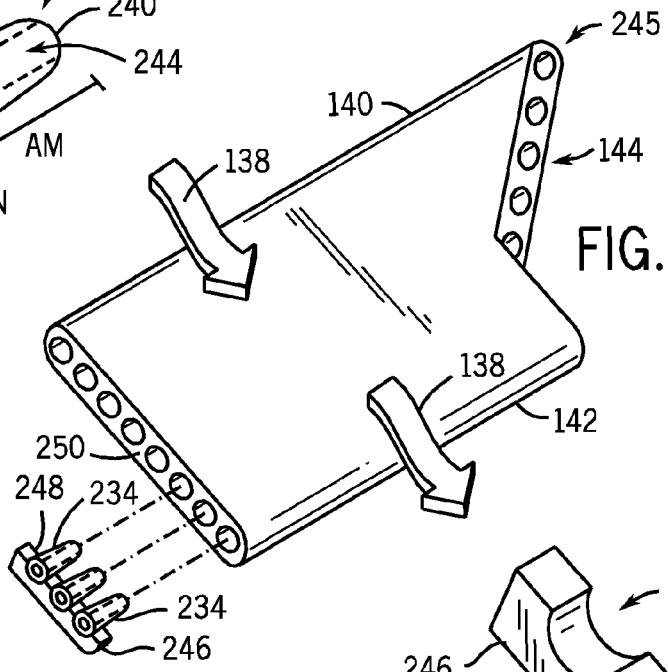
FIG. 20
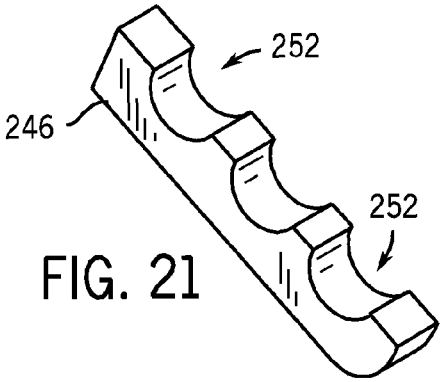
FIG. 21

FIG. 27
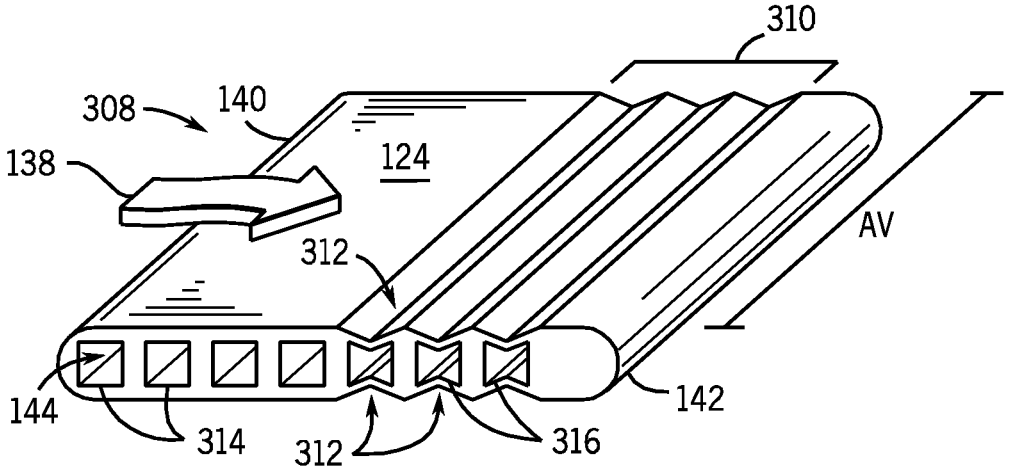
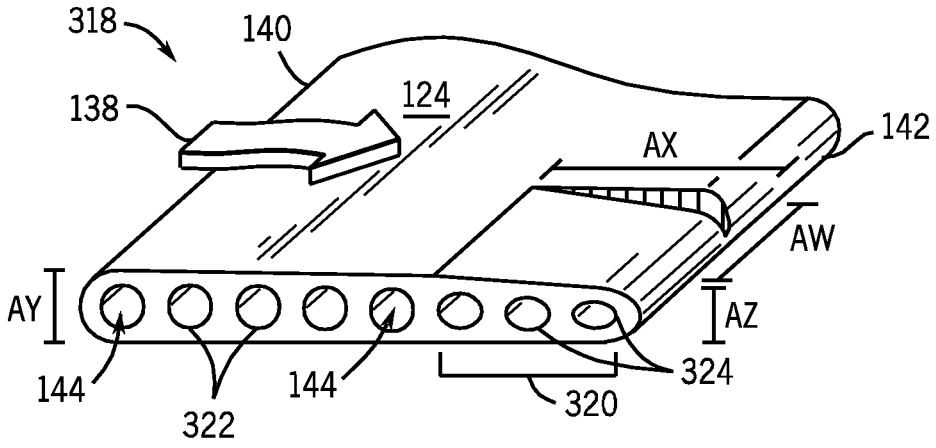
FIG. 28

MULTICHANNEL HEAT EXCHANGER WITH DISSIMILAR FLOW

CROSS REFERENCE TO RELATED APPLICATIONS

This application is a divisional of U.S. patent application Ser. No. 12/200,471, filed Aug. 28, 2008, entitled "MULTICHANNEL HEAT EXCHANGER WITH DISSIMILAR FLOW", which is hereby incorporated by reference.

BACKGROUND

The invention relates generally to multichannel heat exchangers with dissimilar flow across the width of multichannel tubes.

Heat exchangers are used in heating, ventilation, air conditioning, and refrigeration (HVAC&R) systems. Multichannel heat exchangers generally include multichannel tubes for flowing refrigerant through the heat exchanger. Each multichannel tube may contain several individual flow channels, or paths. Fins may be positioned between the tubes to facilitate heat transfer between refrigerant contained within the flow paths and an external fluid passing over the tubes. Moreover, multichannel heat exchangers may be used in small tonnage systems, such as residential systems, or in large tonnage systems, such as industrial chiller systems.

The transfer of heat within multichannel heat exchangers is generally driven by flow of an external fluid passing through the heat exchanger. Typically, as the fluid passes through the heat exchanger (i.e., over the tubes), the fluid contacts the individual multichannel tubes and flows across each tube, contacting first a leading edge of the tube, flowing across the width of the tube, and contacting last a trailing edge of the tube. Heat transfer between the external fluid and the refrigerant is dependent on, among other things, the temperature difference between the external fluid flowing across the multichannel tubes and the refrigerant flowing inside the multichannel tubes. For example, in an evaporator, an external fluid, such as air, may flow over the multichannel tubes. The refrigerant flowing inside the multichannel tubes is generally cooler than the air and, therefore, absorbs heat from the air. The exchange of heat may produce cooled air exiting the heat exchanger and warmed refrigerant flowing within the heat exchanger. In an example employing a condenser, an external fluid, such as air, may flow over multichannel tubes containing a refrigerant that is generally warmer than the air. As the air flows across the tubes, the internal refrigerant transfers heat to the air. The exchange of heat may produce warmed air exiting the heat exchanger and cooled refrigerant flowing within the heat exchanger.

In both evaporator and condenser applications, the greatest temperature difference between the external fluid flowing across the tubes and the internal refrigerant flowing within the tubes generally exists at the leading edge of the tubes. As the external fluid flows across the width of the tubes, heat transfer occurs causing the external fluid temperature to approach the temperature of the internal refrigerant. Therefore, less heat transfer may occur at the trailing edge of the tubes because the external fluid has already absorbed or transferred some heat to or from the internal refrigerant.

SUMMARY

The present invention relates to a heat exchanger with a first manifold, a second manifold, a plurality of multichannel tubes in fluid communication with the manifolds, and a plurality of generally parallel flow paths disposed lengthwise within each multichannel tube. The multichannel tubes are configured to receive an external fluid flowing across a width dimension extending from a leading edge to a trailing edge, and the flow paths are configured to favor flow of an internal fluid within each multichannel tube near the leading edge. A flow control mechanism may be included in a multichannel tube near the end of the tube containing the lowest vapor quality.

The present invention also relates to a multichannel tube for a heat exchanger. The tube includes a leading edge configured to be contacted by an external fluid, a trailing edge configured to by contacted by the external fluid after contact with the leading edge, and two or more generally parallel flow paths extending along the length of the tube. The flow paths are configured to effect a first flow of an internal fluid within the tube near the leading edge and a second flow of the internal fluid within the tube near the trailing edge. The second flow is reduced with respect to the first flow.

The present invention further relates to systems and methods employing the heat exchangers and multichannel tubes.

DRAWINGS

FIG. 1 is perspective view of an exemplary residential air conditioning or heat pump system of the type that might employ a heat exchanger in accordance with the present techniques.

FIG. 2 is a partially exploded view of the outside unit of the system of FIG. 1, with an upper assembly lifted to expose certain of the system components.

FIG. 3 is a perspective view of an exemplary commercial or industrial HVAC&R system that employs a chiller and air handlers to cool a building and that may also employ heat exchangers in accordance with the present techniques.

FIG. 6 is a perspective view of an exemplary heat exchanger containing multichannel tubes in accordance with the present techniques.

FIG. 7 is a detailed perspective view of a section of multichannel tubes and fins employed in the heat exchanger of FIG. 6.

FIG. 8 is a partially exploded detailed perspective view of a portion of the heat exchanger of FIG. 6 illustrating component parts.

FIG. 17 is a detailed perspective view of an exemplary multichannel tube including flow control mechanisms inserted within the flow paths.

FIG. 18 is a detailed perspective view of a flow control mechanism employed in FIG. 17.

FIG. 19 is a detailed perspective view of an alternate flow control mechanism that may be inserted into an exemplary multichannel tube.

FIG. 20 is a detailed perspective view of an exemplary multichannel tube including the flow control mechanism of FIG. 19 inserted within flow paths.

FIG. 21 is a detailed perspective view of a bracket that may be used to insert the flow control mechanisms of FIG. 20.

FIG. 27 is a detailed perspective view of an exemplary multichannel tube including a flow control mechanism that encompasses a section of the tube.

FIG. 28 is a detailed perspective view of an alternate flow control mechanism that may be included within a section of an exemplary multichannel tube.

DETAILED DESCRIPTION

Figure 4:
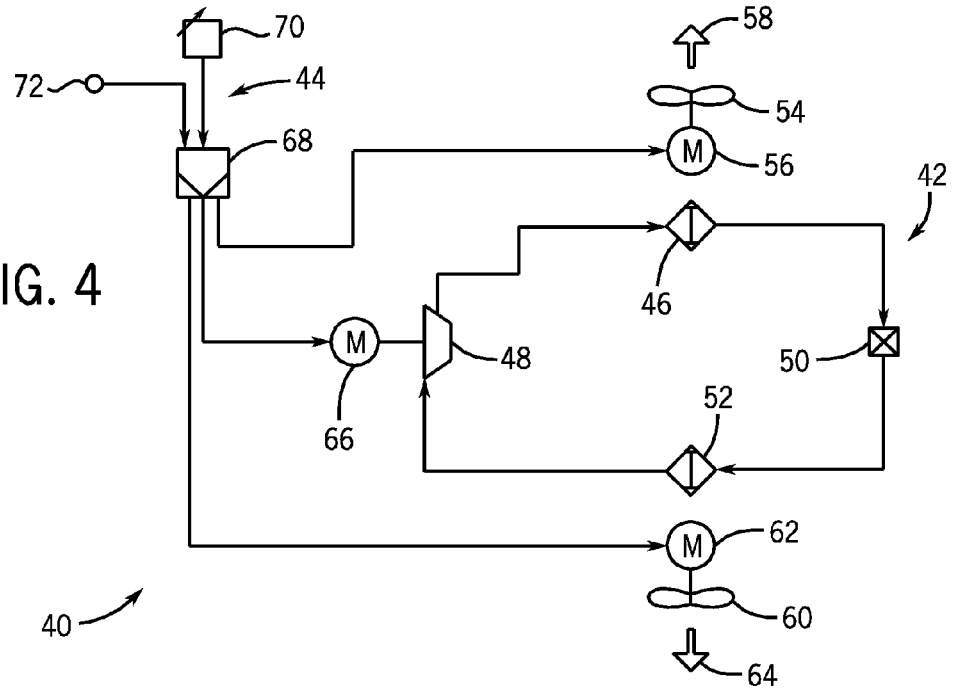
FIG. 4 is a diagrammatical overview of an exemplary air conditioning system that may employ one or more heat exchangers in accordance with the present techniques.

FIGS. 1 through 3 depict exemplary applications for heat exchangers. Such systems, in general, may be applied in a range of settings, both within the HVAC&R field and outside of that field. In presently contemplated applications, however, heat exchanges may be used in residential, commercial, light industrial, industrial, and in any other application for heating or cooling a volume or enclosure, such as a residence, building, structure, and so forth. Moreover, the heat exchanges may be used in industrial applications, where appropriate, for basic refrigeration and heating of various fluids. FIG. 1 illustrates a residential heating and cooling system. In general, a residence 10, will include refrigerant conduits 12 that operatively couple an indoor unit 14 to an outdoor unit 16. Indoor unit 14 may be positioned in a utility room, an attic, a basement, and so forth. Outdoor unit 16 is typically situated adjacent to a side of residence 10 and is covered by a shroud to protect the system components and to prevent leaves and other contaminants from entering the unit. Refrigerant conduits 12 transfer refrigerant between indoor unit 14 and outdoor unit 16, typically transferring primarily liquid refrigerant in one direction and primarily vaporized refrigerant in an opposite direction.

When the system shown in FIG. 1 is operating as an air conditioner, a coil in outdoor unit 16 serves as a condenser for recondensing vaporized refrigerant flowing from indoor unit 14 to outdoor unit 16 via one of the refrigerant conduits 12. In these applications, a coil of the indoor unit, designated by the reference numeral 18, serves as an evaporator coil. Evaporator coil 18 receives liquid refrigerant (which may be expanded by an expansion device, not shown) and evaporates the refrigerant before returning it to outdoor unit 16.

Outdoor unit 16 draws in environmental air through its sides as indicated by the arrows directed to the sides of the unit, forces the air through the outer unit coil by a means of a fan (not shown), and expels the air as indicated by the arrows above the outdoor unit. When operating as an air conditioner, the air is heated by the condenser coil within the outdoor unit and exits the top of the unit at a temperature higher than it entered the sides. Air is blown over indoor coil 18 and is then circulated through residence 10 by means of ductwork 20, as indicated by the arrows entering and exiting ductwork 20. The overall system operates to maintain a desired temperature as set by a thermostat 22 or other control device or system (e.g., a computer, digital or analog controller, etc.). When the temperature sensed inside the residence is higher than the set point on the thermostat (plus a small amount), the air conditioner will become operative to refrigerate additional air for circulation through the residence. When the temperature reaches the set point (minus a small amount), the unit will stop the refrigeration cycle temporarily.

When the unit in FIG. 1 operates as a heat pump, the roles of the coils are simply reversed. That is, the coil of outdoor unit 16 will serve as an evaporator to evaporate refrigerant and thereby cool air entering outdoor unit 16 as the air passes over the outdoor unit coil. Indoor coil 18 will receive a stream of air blown over it and will heat the air by condensing a refrigerant.

FIG. 2 illustrates a partially exploded view of one of the units shown in FIG. 1, in this case outdoor unit 16. In general, the unit may be thought of as including an upper assembly 24 made up of a shroud, a fan assembly, a fan drive motor, and so forth. In the illustration of FIG. 2, the fan and fan drive motor are not visible because they are hidden by the surrounding shroud. An outdoor coil 26 is housed within this shroud and is generally deposed to surround or at least partially surround other system components, such as a compressor, an expansion device, a control circuit.

FIG. 3 illustrates another exemplary application, in this case an HVAC&R system for building environmental management. A building 28 is cooled by a system that includes a chiller 30, which is typically disposed on or near the building, or in an equipment room or basement. Chiller 30 is an air-cooled device that implements a refrigeration cycle to cool water. The water is circulated to building 28 through water conduits 32. The water conduits are routed to air handlers 34 at individual floors or sections of the building. The air handlers are also coupled to ductwork 36 that is adapted to blow air from an outside intake 38.

Chiller 30, which includes heat exchangers for both evaporating and condensing a refrigerant as described above, cools water that is circulated to the air handlers. Air blown over additional coils that receive the water in the air handlers causes the water to increase in temperature and the circulated air to decrease in temperature. The cooled air is then routed to various locations in the building via additional ductwork. Ultimately, distribution of the air is routed to diffusers that deliver the cooled air to offices, apartments, hallways, and any other interior spaces within the building. In many applications, thermostats or other command devices (not shown in FIG. 3) will serve to control the flow of air through and from the individual air handlers and ductwork to maintain desired temperatures at various locations in the structure.

FIG. 4 illustrates an air conditioning system 40, which may employ multichannel tube heat exchangers. Refrigerant flows through system 40 within closed refrigeration loop 42. The refrigerant may be any fluid that absorbs and extracts heat. For example, the refrigerant may be hydrofluorocarbon (HFC) based R-410A, R-407C, or R-134a, or it may be carbon dioxide (R-744) or ammonia (R-717). Air conditioning system 40 includes control devices 44 that enable the system to cool an environment to a prescribed temperature.

System 40 cools an environment by cycling refrigerant within closed refrigeration loop 42 through a condenser 46, a compressor 48, an expansion device 50, and an evaporator 52. The refrigerant enters condenser 46 as a high pressure and temperature vapor and flows through the multichannel tubes of the condenser. A fan 54, which is driven by a motor 56, draws air across the multichannel tubes. The fan may push or pull air across the tubes. As the air flows across the tubes, heat transfers from the refrigerant vapor to the air, producing heated air 58 and causing the refrigerant vapor to condense into a liquid. The liquid refrigerant then flows into an expansion device 50 where the refrigerant expands to become a low pressure and temperature liquid. Typically, expansion device 50 will be a thermal expansion valve (TXV); however, according to other exemplary embodiments, the expansion device may be an orifice or a capillary tube. After the refrigerant exits the expansion device, some vapor refrigerant may be present in addition to the liquid refrigerant.

From expansion device 50, the refrigerant enters evaporator 52 and flows through the evaporator multichannel tubes. A fan 60, which is driven by a motor 62, draws air across the multichannel tubes. As the air flows across the tubes, heat transfers from the air to the refrigerant liquid, producing cooled air 64 and causing the refrigerant liquid to boil into a vapor. According to certain embodiments, the fan may be replaced by a pump that draws fluid across the multichannel tubes.

The refrigerant then flows to compressor 48 as a low pressure and temperature vapor. Compressor 48 reduces the volume available for the refrigerant vapor, consequently, increasing the pressure and temperature of the vapor refrigerant. The compressor may be any suitable compressor such as a screw compressor, reciprocating compressor, rotary compressor, swing link compressor, scroll compressor, or turbine compressor. Compressor 48 is driven by a motor 66 that receives power from a variable speed drive (VSD) or a direct AC or DC power source. According to an exemplary embodiment, motor 66 receives fixed line voltage and frequency from an AC power source although in certain applications the motor may be driven by a variable voltage or frequency drive. The motor may be a switched reluctance (SR) motor, an induction motor, an electronically commutated permanent magnet motor (ECM), or any other suitable motor type. The refrigerant exits compressor 48 as a high temperature and pressure vapor that is ready to enter the condenser and begin the refrigeration cycle again.

The control devices 44, which include control circuitry 68, an input device 70, and a temperature sensor 72, govern the operation of the refrigeration cycle. Control circuitry 68 is coupled to the motors 56, 62, and 66 that drive condenser fan 54, evaporator fan 60, and compressor 48, respectively. Control circuitry 68 uses information received from input device 70 and sensor 72 to determine when to operate the motors 56, 62, and 66 that drive the air conditioning system. In certain applications, the input device may be a conventional thermostat. However, the input device is not limited to thermostats, and more generally, any source of a fixed or changing set point may be employed. These may include local or remote command devices, computer systems and processors, and mechanical, electrical and electromechanical devices that manually or automatically set a temperature-related signal that the system receives. For example, in a residential air conditioning system, the input device may be a programmable 24-volt thermostat that provides a temperature set point to the control circuitry. Sensor 72 determines the ambient air temperature and provides the temperature to control circuitry 68. Control circuitry 68 then compares the temperature received from the sensor to the temperature set point received from the input device. If the temperature is higher than the set point, control circuitry 68 may turn on motors 56, 62, and 66 to run air conditioning system 40. The control circuitry may execute hardware or software control algorithms to regulate the air conditioning system. According to exemplary embodiments, the control circuitry may include an analog to digital (A/D) converter, a microprocessor, a non-volatile memory, and an interface board. Other devices may, of course, be included in the system, such as additional pressure and/or temperature transducers or switches that sense temperatures and pressures of the refrigerant, the heat exchangers, the inlet and outlet air, and so forth.

Figure 5:
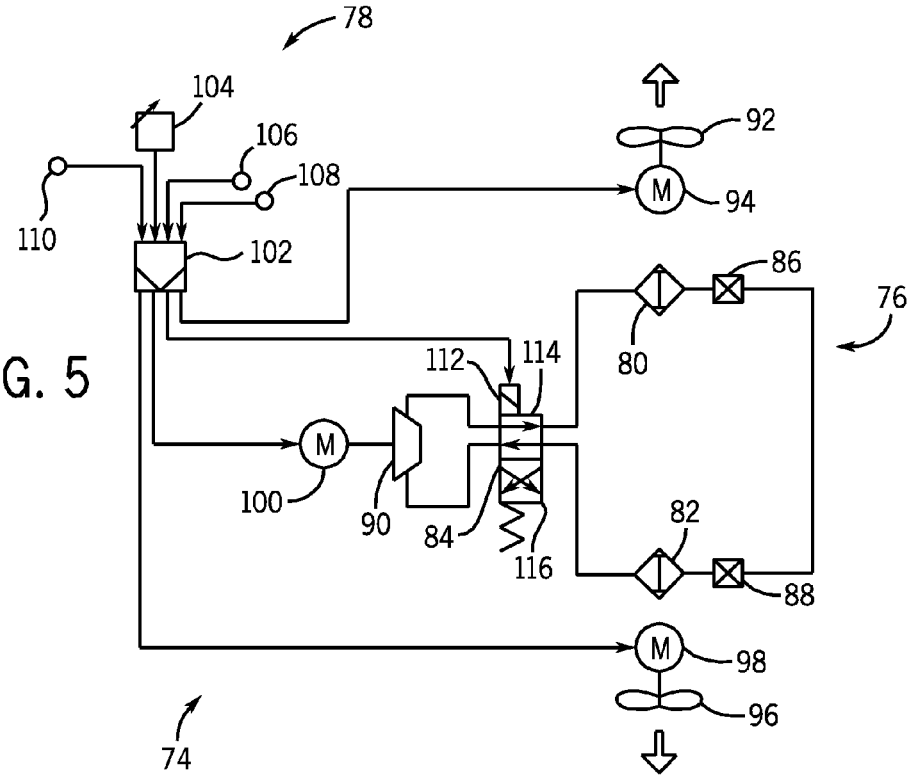
FIG. 5 is a diagrammatical overview of an exemplary heat pump system that may employ one or more heat exchangers in accordance with the present techniques.

FIG. 5 illustrates a heat pump system 74 that may employ multichannel tube heat exchangers. Because the heat pump may be used for both heating and cooling, refrigerant flows through a reversible refrigeration/heating loop 76. The refrigerant may be any fluid that absorbs and extracts heat. The heating and cooling operations are regulated by control devices 78.

Heat pump system 74 includes an outside coil 80 and an inside coil 82 that both operate as heat exchangers. The coils may function either as an evaporator or a condenser depending on the heat pump operation mode. For example, when heat pump system 74 is operating in cooling (or "AC") mode, outside coil 80 functions as a condenser, releasing heat to the outside air, while inside coil 82 functions as an evaporator, absorbing heat from the inside air. When heat pump system 74 is operating in heating mode, outside coil 80 functions as an evaporator, absorbing heat from the outside air, while inside coil 82 functions as a condenser, releasing heat to the inside air. A reversing valve 84 is positioned on reversible loop 76 between the coils to control the direction of refrigerant flow and thereby to switch the heat pump between heating mode and cooling mode.

Heat pump system 74 also includes two metering devices 86 and 88 for decreasing the pressure and temperature of the refrigerant before it enters the evaporator. The metering devices also regulate the refrigerant flow entering the evaporator so that the amount of refrigerant entering the evaporator equals, or approximately equals, the amount of refrigerant exiting the evaporator. The metering device used depends on the heat pump operation mode. For example, when heat pump system 74 is operating in cooling mode, refrigerant bypasses metering device 86 and flows through metering device 88 before entering inside coil 82, which acts as an evaporator. In another example, when heat pump system 74 is operating in heating mode, refrigerant bypasses metering device 88 and flows through metering device 86 before entering outside coil 80, which acts as an evaporator. According to other exemplary embodiments, a single metering device may be used for both heating mode and cooling mode. The metering devices typically are thermal expansion valves (TXV), but also may be orifices or capillary tubes.

The refrigerant enters the evaporator, which is outside coil 80 in heating mode and inside coil 82 in cooling mode, as a low temperature and pressure liquid. Some vapor refrigerant also may be present as a result of the expansion process that occurs in metering device 86 or 88. The refrigerant flows through multichannel tubes in the evaporator and absorbs heat from the air changing the refrigerant into a vapor. In cooling mode, the indoor air flowing across the multichannel tubes also may be dehumidified. The moisture from the air may condense on the outer surface of the multichannel tubes and consequently be removed from the air.

After exiting the evaporator, the refrigerant passes through reversing valve 84 and into a compressor 90. Compressor 90 decreases the volume of the refrigerant vapor, thereby, increasing the temperature and pressure of the vapor. The compressor may be any suitable compressor such as a screw compressor, reciprocating compressor, rotary compressor, swing link compressor, scroll compressor, or turbine compressor.

From compressor 90, the increased temperature and pressure vapor refrigerant flows into a condenser, the location of which is determined by the heat pump mode. In cooling mode, the refrigerant flows into outside coil 80 (acting as a condenser). A fan 92, which is powered by a motor 94, draws air across the multichannel tubes containing refrigerant vapor. According to certain exemplary embodiments, the fan may be replaced by a pump that draws fluid across the multichannel tubes. The heat from the refrigerant is transferred to the outside air causing the refrigerant to condense into a liquid. In heating mode, the refrigerant flows into inside coil 82 (acting as a condenser). A fan 96, which is powered by a motor 98, draws air across the multichannel tubes containing refrigerant vapor. The heat from the refrigerant is transferred to the inside air causing the refrigerant to condense into a liquid.

After exiting the condenser, the refrigerant flows through the metering device (86 in heating mode and 88 in cooling mode) and returns to the evaporator (outside coil 80 in heating mode and inside coil 82 in cooling mode) where the process begins again.

In both heating and cooling modes, a motor 100 drives compressor 90 and circulates refrigerant through reversible refrigeration/heating loop 76. The motor may receive power either directly from an AC or DC power source or from a variable speed drive (VSD). The motor may be a switched reluctance (SR) motor, an induction motor, an electronically commutated permanent magnet motor (ECM), or any other suitable motor type.

The operation of motor 100 is controlled by control circuitry 102. Control circuitry 102 receives information from an input device 104 and sensors 106, 108, and 110 and uses the information to control the operation of heat pump system 74 in both cooling mode and heating mode. For example, in cooling mode, input device 104 provides a temperature set point to control circuitry 102. Sensor 110 measures the ambient indoor air temperature and provides it to control circuitry 102. Control circuitry 102 then compares the air temperature to the temperature set point and engages compressor motor 100 and fan motors 94 and 98 to run the cooling system if the air temperature is above the temperature set point. In heating mode, control circuitry 102 compares the air temperature from sensor 110 to the temperature set point from input device 104 and engages motors 94, 98, and 100 to run the heating system if the air temperature is below the temperature set point.

Control circuitry 102 also uses information received from input device 104 to switch heat pump system 74 between heating mode and cooling mode. For example, if input device 104 is set to cooling mode, control circuitry 102 will send a signal to a solenoid 112 to place reversing valve 84 in an air conditioning position 114. Consequently, the refrigerant will flow through reversible loop 76 as follows: the refrigerant exits compressor 90, is condensed in outside coil 80, is expanded by metering device 88, and is evaporated by inside coil 82. If the input device is set to heating mode, control circuitry 102 will send a signal to solenoid 112 to place reversing valve 84 in a heat pump position 116. Consequently, the refrigerant will flow through the reversible loop 76 as follows: the refrigerant exits compressor 90, is condensed in inside coil 82, is expanded by metering device 86, and is evaporated by outside coil 80.

The control circuitry may execute hardware or software control algorithms to regulate heat pump system 74. According to exemplary embodiments, the control circuitry may include an analog to digital (A/D) converter, a microprocessor, a non-volatile memory, and an interface board.

The control circuitry also may initiate a defrost cycle when the system is operating in heating mode. When the outdoor temperature approaches freezing, moisture in the outside air that is directed over outside coil 80 may condense and freeze on the coil. Sensor 106 measures the outside air temperature, and sensor 108 measures the temperature of outside coil 80. These sensors provide the temperature information to the control circuitry which determines when to initiate a defrost cycle. For example, if either sensor 106 or 108 provides a temperature below freezing to the control circuitry, system 74 may be placed in defrost mode. In defrost mode, solenoid 112 is actuated to place reversing valve 84 in air conditioning position 114, and motor 94 is shut off to discontinue air flow over the multichannel tubes. System 74 then operates in cooling mode until the increased temperature and pressure refrigerant flowing through outside coil 80 defrosts the coil. Once sensor 108 detects that coil 80 is defrosted, control circuitry 102 returns the reversing valve 84 to heat pump position 146. As will be appreciated by those skilled in the art, the defrost cycle can be set to occur at many different time and temperature combinations.

FIG. 6 is a perspective view of an exemplary heat exchanger that may be used in air conditioning system 40, shown in FIG. 4, or heat pump system 70, shown in FIG. 5. The exemplary heat exchanger may be a condenser 46, an evaporator 52, an outside coil 80, or an inside coil 82, as shown in FIGS. 4 and 5. It should be noted that in similar or other systems, the heat exchanger may be used as part of a chiller or in any other heat exchanging application. The heat exchanger includes manifolds 120 and 122 that are connected by multichannel tubes 124. Although 30 tubes are shown in FIG. 6, the number of tubes may vary. The manifolds and tubes may be constructed of aluminum or any other material that promotes good heat transfer. Refrigerant flows from manifold 120 through a set of first tubes 126 to manifold 122. The refrigerant then returns to manifold 120 in an opposite direction through a set of second tubes 128. The first tubes may have the same configuration as the second tubes or the first tubes may have a different configuration from the second tubes. According to other exemplary embodiments, the heat exchanger may be rotated approximately 90 degrees so that the multichannel tubes run vertically between a top manifold and a bottom manifold. Furthermore, the heat exchanger may be inclined at an angle relative to the vertical. Although the multichannel tubes are depicted as having an oblong shape, the tubes may be any shape, such as tubes with a cross-section in the form of a rectangle, square, circle, oval, ellipse, triangle, trapezoid, or parallelogram. According to exemplary embodiments, the tubes may have an oblong cross-sectional shape with a height ranging from 0.5 mm to 3 mm and a width ranging from 18 mm to 25 mm. It should also be noted that the heat exchanger may be provided in a single plane or slab, or may include bends, corners, contours, and so forth.

According to certain exemplary embodiments, the construction of the first tubes may differ from the construction of the second tubes. Tubes may also differ within each section. For example, the tubes may all have identical cross-sections, where the tubes in the first section may be rectangular while the tubes in the second section are oval. The internal construction of the tubes as described below with regard to FIGS. 11 through 28 may also vary within and across tube sections such that the internal flow paths are of different configurations or have various flow control mechanisms included in them.

Refrigerant enters the heat exchanger through an inlet 130 and exits the heat exchanger through an outlet 132. Although FIG. 6 depicts the inlet at the top of manifold 120 and the outlet at the bottom of manifold 120, the inlet and outlet positions may be interchanged so that the fluid enters at the bottom and exits at the top. The fluid also may enter and exit the manifold from multiple inlets and outlets positioned on bottom, side, or top surfaces of the manifold. Baffles 134 separate the inlet and outlet portions of manifold 120. Although a double baffle 134 is illustrated, any number of one or more baffles may be employed to create separation of the inlet and outlet portions. It should also be noted that according to other exemplary embodiments, the inlet and outlet may be contained on separate manifolds, eliminating the need for a baffle.

Fins 136 are located between multichannel tubes 124 to promote the transfer of heat between the tubes and the environment. According to an exemplary embodiment, the fins are constructed of aluminum, brazed or otherwise joined to the tubes, and disposed generally perpendicular to the flow of refrigerant. However, according to other exemplary embodiments, the fins may be made of other materials that facilitate heat transfer and may extend parallel or at varying angles with respect to the flow of the refrigerant. The fins may be louvered fins, corrugated fins, or any other suitable type of fin.

When an external fluid, such as air, flows across multichannel tubes 124, as generally indicated by arrows 138, heat transfer occurs between the refrigerant flowing within tubes 124 and the external fluid. Typically, the external fluid, shown here as air, flows through fins 136 contacting the upper and lower sides of multichannel tubes 124. The external fluid first contacts multichannel tubes 124 at a leading edge 140, then flows across the width of the tubes, and lastly contacts a trailing edge 142 of the tubes. As the external fluid flows across the tubes, heat is transferred to and from the tubes to the external fluid. For example, in a condenser, the external fluid is generally cooler than the fluid flowing within the multichannel tubes. As the external fluid contacts the leading edge of a multichannel tube, heat is transferred from the refrigerant within the multichannel tube to the external fluid. Consequently, the external fluid is heated as it passes over the multichannel tubes and the refrigerant flowing within the multichannel tubes is cooled. In an evaporator, the external fluid generally has a temperature higher than the refrigerant flowing within the multichannel tubes. Consequently, as the external fluid contacts the leading edge of the multichannel tubes, heat is transferred from the external fluid to the refrigerant flowing in the tubes to heat the refrigerant. The external fluid leaving the multichannel tubes is then cooled because the heat has been transferred to the refrigerant.

FIG. 7 is a detailed perspective view of tubes 124 and fins 136 illustrated in FIG. 6, sectioned through the tubes and fins. An external fluid, indicated generally by arrows 138, flows through fins 136 and across a width A of tubes 124, contacting the upper and lower surfaces of the tubes. Fins 136 function to promote heat transfer between the refrigerant flowing within tubes 124 and the external fluid flowing across the tubes. The external fluid, shown here as air, first contacts a leading edge 140, flows across width A of a tube 124, and lastly contacts in a trailing edge 142. Refrigerant flows within multichannel tubes 124 through flow paths 144 in a direction generally perpendicular to the direction of air flow 138. Each tube 124 has a width A across which the external fluid 138 passes. Each tube 124 also has a height B, which is typically much smaller than width A. As the external fluid flows across width A of the multichannel tubes, heat is transferred between the refrigerant and the external fluid. The temperature difference between the refrigerant and the external fluid is typically the greatest at leading edge 140 because no, or minimal, heat transfer has occurred between the external fluid and the refrigerant. Specifically, as the external fluid flows across tube width A, the fluid absorbs or transfers heat from or to the refrigerant within the tubes. Because of the heat transfer, the temperature of the external fluid approaches the temperature of the refrigerant as the fluid travels across the width. Therefore, more heat transfer may occur at leading edge 140 of the tubes (where the temperature difference is generally greatest) than at trailing edge 142 (where the temperature difference is generally smallest).

FIG. 8 illustrates certain components of the heat exchanger of FIG. 6 in a somewhat more detailed exploded view. Each manifold (manifold 120 being shown in FIG. 8) is a tubular structure with open ends that are closed by a cap 146. Openings, or apertures, 148 are formed in the manifolds, such as by conventional piercing operations. Multichannel tubes 124 may then be inserted into openings 148 in a generally parallel fashion. Ends 150 of the tubes are inserted into openings 148 so that fluid may flow from the manifold into flow paths within the tubes. During insertion of the tubes within the manifold, leading edge 140 and trailing edge 142 may be determined by the orientation of the tubes. In certain manufacturing processes, the leading edge and trailing edge may be marked on the tube using a process such as stamping allowing the leading edge and trailing edge of each tube to be lined up in parallel during insertion. Fins 136 may then be inserted between the tubes 124 to promote heat transfer between an external fluid, such as air or water, and the refrigerant flowing within the tubes.

Figure 9:
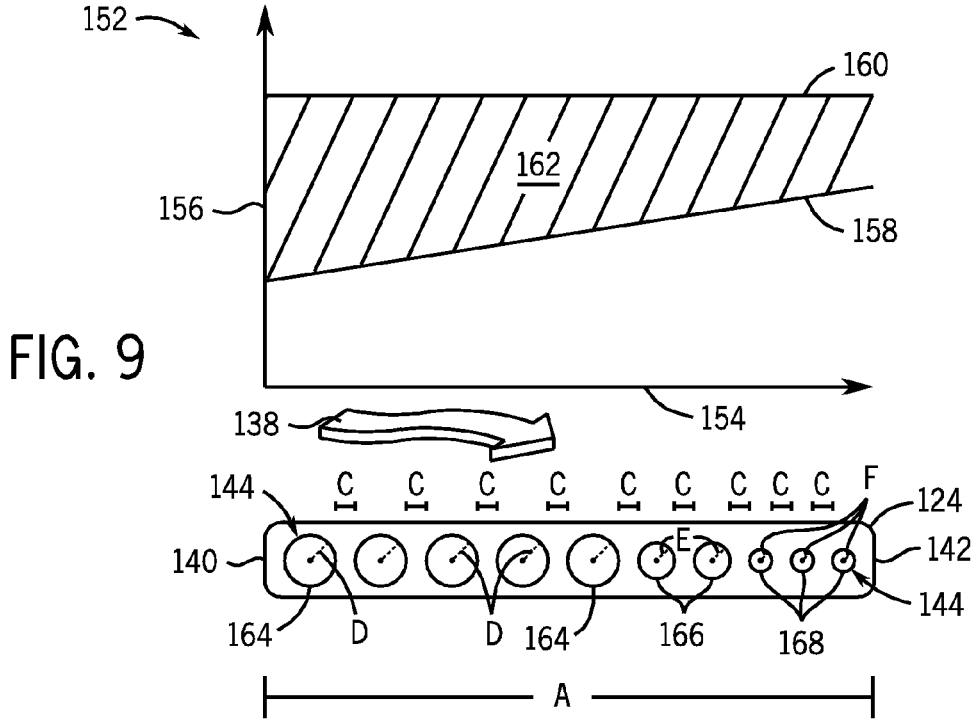
FIG. 9 is a sectional view of an exemplary multichannel tube with varying flow areas separated by a constant spacing depicted below a corresponding temperature profile across the width of the multichannel tube functioning in a condenser in accordance with the present techniques.

FIG. 9 illustrates a temperature profile 152 for a multichannel tube 124 that is included in a condenser. Temperature profile 152 depicts the change in temperature across width A of multichannel tube 124. An x-axis 154 represents the distance across tube width A, and a y-axis 156 represents the temperatures of the refrigerant within tube 124 and the external fluid flowing across tube 124. The temperature of the external fluid is represented by air temperature 158, and the temperature of the refrigerant is represented by condensing temperature 160. At leading edge 140, air temperature 158 is much lower than condensing temperature 160. As the air flows across width A, the air is heated by heat received from refrigerant flowing within tube 124. Consequently, the temperature of the air increases across width A so that at trailing edge 142 air temperature 158 is greater than it was at leading edge 140. Note that condensing temperature 160 has remained fairly constant causing a temperature difference 162, indicated generally by the shaded area, to decrease across width A. Temperature difference 162 represents the temperature difference between condensing temperature 160 air temperature 158. Because heat transfer is a function of the temperature difference 162, more heat transfer may occur near leading edge 140 where the temperature difference 162 is greater.

FIG. 9 also illustrates the internal configuration of flow paths 144 across width A of tube 124. The internal configuration is intended to maximize heat transfer for temperature profile 152. Flow paths 144 are spaced apart at a constant spacing C with the size of the flow paths decreasing across width A in the direction of air flow 138. Flow paths 164 are located near leading edge 140 and have a first size illustrated by a radius D. Flow paths 166 are located farther from leading edge 140 and have a second size, illustrated by a radius E. Note that radius E is smaller than radius D, resulting in flow paths 166 having a smaller flow area than flow paths 164. Flow paths 168 are located farthest from leading edge 140 and have a third size, illustrated by a radius F. Radius F is the smallest of the radii D, E, and F, resulting in flow paths 168 having the smallest flow area within tube 124. Consequently, as the flow paths 164, 166, and 168 are located farther away from leading edge 140, the size of the flow paths, and consequently, the flow area within the flow paths, decreases. Flow paths 164, located closest to leading edge 140, have the largest flow area and, thus, are able to accommodate the highest amount of refrigerant while flow paths 168, located farthest from leading edge 140, have the smallest flow area, and thus, are able to accommodate the least amount of refrigerant flow. Thus, the tube is configured to allow more refrigerant to flow near leading edge 140 where temperature difference 162 is the greatest.

Figure 10:
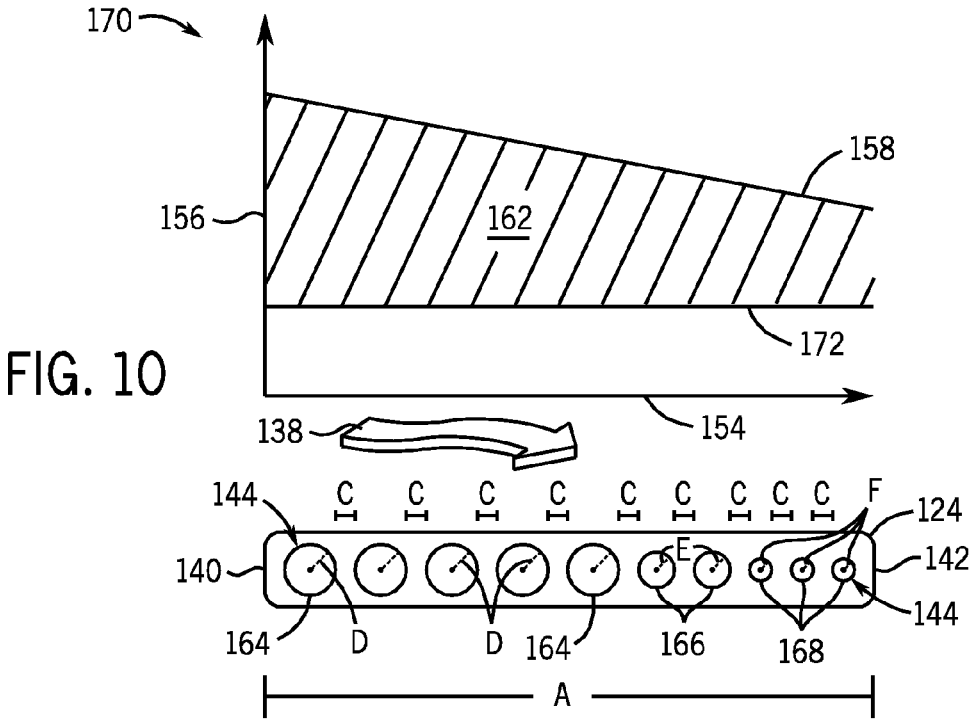
FIG. 10 is a sectional view of the exemplary multichannel tube shown in FIG. 9 depicted below a corresponding temperature profile across the width of the multichannel tube functioning in an evaporator in accordance with the present techniques.

FIG. 10 illustrates a temperature profile 170 for multichannel tube 124 when it is used in a heat exchanger functioning as an evaporator. Temperature profile 170 depicts the changing temperature across width A of tube 124. X-axis 154 represents the distance across width A, and y-axis 156 represents the temperature of the refrigerant and the external fluid, which in this case is air. Temperature difference 162, shown by the hatched area, represents the temperature difference between the air flowing over tube 124 and the refrigerant flowing within tube 124. Because tube 124 is located in an evaporator, an evaporation temperature 172 represents the temperature of the refrigerant. The temperature of the air is represented on temperature profile 170 as air temperature 158. As air, shown generally by arrow 138, flows across tube 124, the temperature of the air decreases to approach evaporation temperature 172. For example, as shown on temperature profile 170, air flow 138 first contacts leading edge 140 when air temperature 158 is much higher than evaporation temperature 172. As the air flows across width A, the air releases heat to the refrigerant flowing within the tube. Consequently, the air is cooled to a temperature that decreases across the width A. As illustrated by temperature profile 170, air temperature 158 at trailing edge 142 is much lower than air temperature 158 at leading edge 140. Evaporation temperature 172 remains relatively constant across width A. Because air temperature 158 approaches evaporation temperature 172 as the air flows across width A, temperature difference 162 decreases across width A. Consequently, more heat transfer may occur at leading edge 140, where the temperature difference is the greatest, than at trailing edge 142, where the temperature difference is the smallest.

As illustrated by FIGS. 9 and 10, the same internal tube configuration may be used in both a condenser and an evaporator. The tube configuration employed in FIG. 10 is the same tube configuration employed in FIG. 9. In FIG. 10, flow paths 164, which are located closest to leading edge 140, have the largest radius, and consequently the largest flow area, allowing more refrigerant to flow near leading edge 140. As flow paths 164, 166, and 168 are located farther from the leading edge 140, their size decreases. For example, flow paths 168 are located closest to trailing edge 142 and have the smallest radius F, resulting in the smallest amount of fluid flow occurring near trailing edge 142. When tube 124 is used in a condenser (FIG. 9) and when tube 124 is used in an evaporator (FIG. 10), leading edge 140 is the edge of the tube closest to the largest flow paths. The consistency of the leading edge location between condensers and evaporators allows the tubes to be marked during manufacturing to specify the leading edge and the trailing edge. Although flow paths of three different size are depicted in FIGS. 9 and 10, the number of different size flow paths within a tube may vary. For example, according to exemplary embodiments, flow paths of five different sizes may be provided. Furthermore, the number of flow paths of each size may vary based on specific properties of the heat exchanger, such as the refrigerant used, the location of the heat exchanger, the tube surface area, and the fin height.

FIGS. 11 through 16 depict alternate flow path configurations for the multichannel tubes. These figures illustrate exemplary cross-sectional shapes for flow paths, exemplary spacing that may be used between the flow paths, and exemplary sizes that may be employed for the flow paths. It should be noted, however, that the shapes and spacing shown throughout the figures are not intended to be limiting, and other optimized shapes, sizes, spacings, and combinations thereof may be provided.

Figure 11:
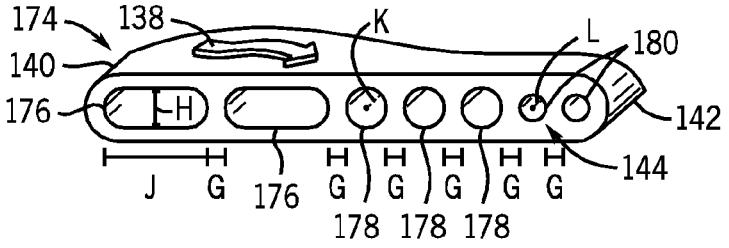
FIG. 11 is a sectional view of an exemplary multichannel tube that may be employed in the heat exchanger of FIG. 6 illustrating flow paths with varying flow areas separated by a constant spacing.

FIG. 11 illustrates an alternate tube 174 with flow paths configured to concentrate flow near leading edge 140. Each of the flow paths 176, 178, 180 are spaced apart at a constant spacing G. However, the size of flow paths 176, 178, and 180 decreases across width A to concentrate flow near leading edge 140. For example, flow paths 176 are located nearest to leading edge 140 and have an oblong shaped opening of a height H and a length J. The oblong shape allows a relatively large amount of flow through flow paths 176. Flow paths 178 are disposed towards the middle of the tube and have a circular cross-section of a radius K. Flow paths 178 have a smaller cross-sectional area than flow paths 176. Flow paths 180 are located closest to trailing edge 142 and have a circular cross-section of a radius L that is smaller than radius K. Flow paths 180 have the smallest cross-section area and, therefore, allow for the least amount of flow.

Figure 12:
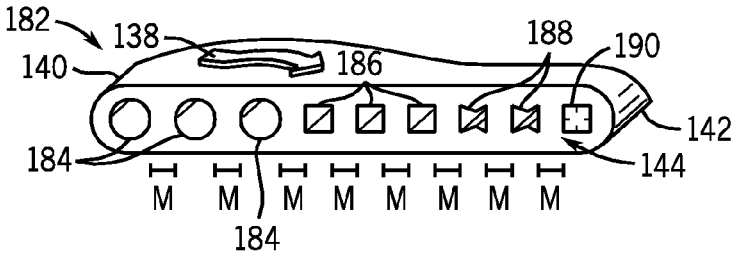
FIG. 12 is a sectional view of an alternate exemplary multichannel tube illustrating flow paths with varying flow areas separated by a constant spacing in accordance with the present techniques.

FIG. 12 illustrates another alternate tube 182 with flow paths configured to concentrate flow near the leading edge of the tube. All of the flow paths 184, 186, 188, and 190 are spaced apart at a constant spacing M. However, flow paths 184, 186, 188, and 190 each have a different cross-sectional size and shape that decreases as the flow paths are located closer to trailing edge 142. Flow paths 184 are located closest to leading edge 140 and have a circular shaped opening with a relatively large cross-sectional area. Flow paths 186 are disposed near the middle of the tube and have a square shaped opening with a cross-sectional area smaller than the cross-sectional area of flow paths 184. Flow paths 188 are located to the right of flow paths 186 and have an even smaller cross-sectional area. Flow paths 188 have a bow-tie shaped cross-section of a size similar to the square shaped opening of flow paths 186; however, the center portions of the square on the top and bottom have been indented to reduce the cross-sectional area of these flow paths. The indentations also may function to increase the frictional pressure drop for these flow paths. Flow path 190 is located closest to the trailing edge and is of the smallest cross-sectional area. The outer cross-section has a size similar to the square shaped openings of flow paths 186; however, flow path 190 has indentations that indent inwards from all four sides of the square and extend throughout the length of the flow path. The indentations are intended to decrease the cross-sectional area of flow path 190 and increase the frictional pressure drop of flow path 190. Flow paths 184, 186, 188, and 190 each have openings of a different shape that is intended to decrease the cross-sectional area of flow paths 184, 186, 188, and 190 across width A from leading edge 140 to trailing edge 142. Consequently, more refrigerant flows within tube 182 near leading edge 140 where temperature difference 162 (see FIGS. 9 and 10) is the greatest.

Figure 13:
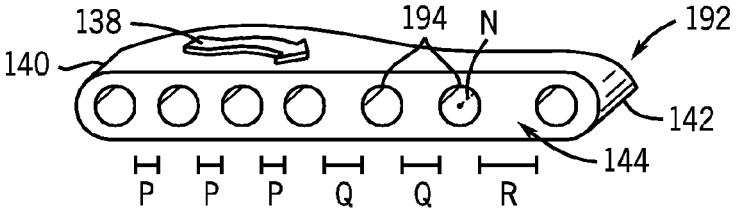
FIG. 13 is a sectional view of an exemplary multichannel tube illustrating flow paths of a constant size separated by a progressive spacing.

FIG. 13 illustrates another alternate tube configuration 192 that includes flow paths 194 of a constant size illustrated by a radius N. Instead of varying the size of the flow paths as shown in FIGS. 9 through 12, the spacing between flow paths 194 has been increased progressively towards trailing edge 142. The increased spacing is intended to concentrate flow near leading edge 140 while utilizing flow paths of a constant size N. The flow paths disposed near leading edge 140 are spaced apart at a first spacing P. The flow paths located near the center of the tube are disposed apart at a distance Q that is greater than distance P. The flow path closest to trailing edge 142 is spaced apart at a distance R that is greater than distances P and Q. Although three distances P, Q, and R are shown in FIG. 13, any number of distances may be used for the spacing between the flow paths. For example, according to an exemplary embodiment, four different spacings may be used, each of which is twice the spacing of the previous spacing located toward the leading edge.

Figure 14:
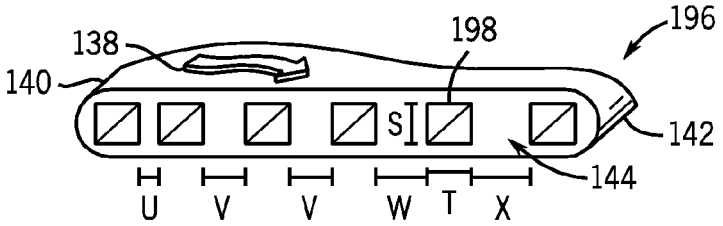
FIG. 14 is a sectional view of an alternate exemplary multichannel tube illustrating flow paths of a constant size separated by a progressive spacing.

The progressively decreasing spacing shown in FIG. 13 also may be used with flow paths of various cross-sectional shapes. For example, FIG. 14 illustrates flow paths 198 that have a rectangular shaped cross-section of a constant size defined by a height S and a width T. The spacing between flow paths 198 increases as the flow paths are located closer to trailing edge 142. The flow path disposed near the leading edge 140 is spaced apart at a distance U. The flow paths located near the center of the tube are spaced apart at a distance V that is twice distance U. The next flow path towards the trailing edge is spaced apart at a distance W, and the flow path disposed closest to trailing edge 142 is spaced apart at a distance X. Distances U, V, W, and X increase across the width from leading edge 140 to trailing edge 142. Consequently, more flow paths are located near leading edge 140 to allow more refrigerant to flow near leading edge 140.

Figure 15:
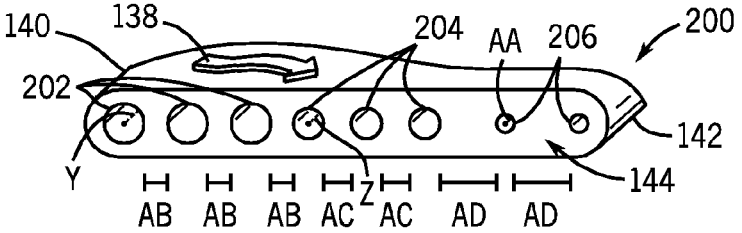
FIG. 15 is a sectional view of an exemplary multichannel tube illustrating flow paths of varying sizes separated by a progressive spacing.
Figure 16:
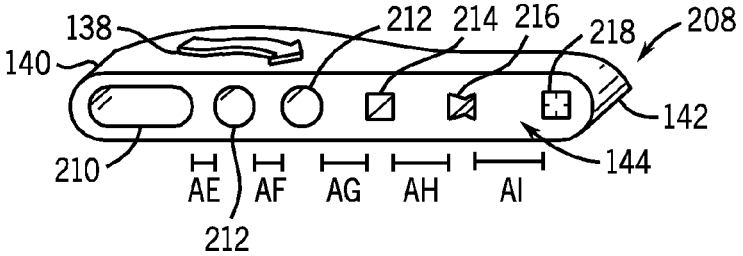
FIG. 16 is a sectional view of an exemplary multichannel tube illustrating flow paths of varying cross-sections and sizes separated by a progressive spacing.

FIGS. 15 and 16 illustrate alternate tube configurations that vary both the size of the flow paths and the spacing across the tube width. In general, the spacing increases and the size decreases from leading edge 140 to trailing edge 142. FIG. 15 illustrates an alternate tube 200 with flow paths of a circular cross-section that decrease in size. Flow paths 202 have a first cross-sectional area illustrated by radius Y and are spaced apart at a distance AB. Flow paths 204 are disposed near the center of the tube and have a smaller cross-sectional area illustrated by a radius Z. Flow paths 204 are spaced apart at a distance AC that is greater than distance AB. The greater distance AC between flow paths 204 and the smaller cross-sectional area results in less flow near the center of the tube than near leading edge 140. Flow paths 206 are disposed nearest to trailing edge 142 and have the smallest cross-sectional area illustrated by radius AA. Flow paths 206 are spaced apart at the largest distance AD. Both the increased spacing between the flow paths and the decreased size of the flow paths is intended to concentrate flow near leading edge 140.

FIG. 16 illustrates another alternate tube 208 that employs not only increased spacing between flow paths and decreased size of the flow paths, but also varying cross-sectional shapes of the flow paths. A flow path 210 is located nearest leading edge 140 and has an oblong shape that yields the largest cross-sectional area of the flow paths within tube 208. Flow path 210 is spaced apart from a flow path 212 at a distance AE. Distance AE is the smallest distance employed within tube 208. To the right of flow path 210 are two flow paths 212 of circular cross-sections that provide a smaller cross sectional area than flow path 210. Flow paths 212 are spaced apart at a distance AF that is slightly larger than distance AE. To the right of flow paths 212 is a flow path 214 of a square cross-section that is smaller than the cross-sections of flow paths 212. Flow path 214 is space apart at a distance AG that is larger than distance AF. To the right of flow path 214 is a flow path 216 of a bow-tie cross-section that is smaller than the cross-sectional area of preceding flow path 214. Flow path 216 is spaced apart at a distance AF that is greater than the previous distances AE, AF, and AG. Finally, a flow path 218 is located nearest trailing edge 142. Flow path 218 has the smallest cross-section and includes indentations along the top, bottom, right and left sides of the opening. Flow path 218 is spaced apart at the greatest spacing AI. The increasing spacing, varying shapes, and decreasing cross-sectional areas are intended to concentrate flow near leading edge 140.

FIGS. 9 through 16 illustrate tube configurations for concentrating refrigerant flow near the leading edge of the tubes by varying the spacing between the flow paths, the flow path shapes, and the cross-sectional areas. These configurations may be employed when the tubes are extruded, or formed, during the manufacturing process. For example, the different size and shape flow paths may be created during manufacturing by an extrusion process where different extrusion dies are used to form the flow paths. According to exemplary embodiments, the tubes may be stamped, or marked, during manufacture to identify the leading edge and/or the trailing edge.

FIGS. 17 through 28 illustrate tube configurations for favoring flow near the leading edge that can be employed either during the manufacture process or after manufacture by modifying existing tubes. FIG. 17 illustrates an alternate tube 220 with flow paths 144 spaced apart at a constant spacing AJ. Each of the flow paths has a constant size illustrated by openings 224. Air flow 138 passes over the tube from leading edge 140 to trailing edge 142. Inserts 222 may be inserted into openings 224 located near trailing edge 142 to reduce their size. Inserts 122 are intended to reduce the size of the flow paths disposed near trailing edge 142 so that flow is concentrated near leading edge 140. According to exemplary embodiments, inserts 222 may be inserted into the tube during manufacturing and joined to the tubes through a process such as brazing or other joining process. According to alternate exemplary embodiments, an existing tube may be modified by placing inserts 222 within the flow paths. The number of flow paths containing inserts may vary depending on specific heat exchanger properties such as the refrigerant used, the flow rate within the tube, and the number of flow paths within the tube. The number of flow paths containing inserts also may vary between tubes within a heat exchanger. For example, in a heat exchanger where tubes located near the bottom receive less air flow, a greater number of inserts may be used in the bottom tubes.

The inserts may be placed in either end of the tube. However, according to a presently contemplated embodiment, the inserts may be placed in the end of the tube containing the lowest vapor quality, that is, the end of the tube containing the lowest ratio of vapor in the refrigerant. For example, in an evaporator, refrigerant typically may enter the tube in the liquid phase. As the refrigerant flows through the length of the tube, it absorbs heat from the hot air flowing over the tube and the liquid changes into a vapor phase. Consequently, the inlet side of the tube contains the most liquid and thus the lowest vapor quality. Therefore, in tubes for use in a heat exchanger functioning as an evaporator, the inserts may be inserted at the inlet side of the tubes. On the other hand, in a condenser, refrigerant enters the tubes primarily in the vapor phase. The refrigerant vapor is cooled by the cool air flowing over the tubes, which causes the vapor condense into a liquid. Consequently, in a condenser, the outlet side of the tube contains the most amount of liquid and therefore has the lowest vapor quality. As a result, the inserts may be placed in the outlet side of the tube flow paths for a condenser.

FIG. 18 is a detailed perspective view of an insert 222 used in FIG. 17. Insert 222 includes a body 226 of a length AK. When inserted, body 226 extends into the flow paths of the multichannel tube. Insert 222 also includes a head 228 that has a cross-section that is larger than the flow path openings. Due to its relatively larger size, head 228 protrudes from the flow path openings 224 (shown in FIG. 17). Head 228 also provides support for insert 222 and prevents insert 222 from sliding too far into the flow path. Head 228 includes an opening 230 adjoining a path 232 extending through body 226. Path 232 allows flow of refrigerant within insert 222 and has a radius AL that is smaller than the flow path openings. The smaller radius reduces the flow area when the insert is inserted within the flow path. Length AK and radius AL may vary depending on how much flow restriction is needed in a multichannel tube. The insert may be constructed of aluminum or other suitable material brazed or otherwise joined to the flow paths.

FIG. 19 illustrates an alternate insert 234 that may be inserted into flow paths of a multichannel tube. Insert 234 includes a body 236, a head 238, and a tapered end 240. Tapered end 240 facilitates insertion into a flow path. Head 238 is of a larger cross-sectional size than the flow path, allowing insert 234 to protrude from the flow path, while a portion of the body 236 is inserted into the flow path to restrict the size of the flow path. Body 236 has a length AM that may be inserted into the flow path. However, according to exemplary embodiments, the entire length may not fit within the flow path. Tapered end 240 allows a common insert to be used for various flow path sizes where the insert will be inserted by varying amounts depending on the size of the flow path opening. Insert 234 contains an opening 242 that is smaller than the flow path opening to allow reduction of the flow path size. A path 244 extends from opening 242 to the end of the insert to allow flow of refrigerant within the insert. Although FIGS. 19 and 20 depict inserts of circular cross-sections, the inserts may have any shape cross-section that fits within the flow paths. For example, inserts of a square shaped cross-section may be inserted into flow paths of a square shaped cross-section.

FIG. 20 illustrates an alternate tube configuration 245 employing insert 234. A mounting bracket 246 may be used to place inserts 234 within flow paths 144. According to exemplary embodiments, the bracket may be constructed of aluminum and may be brazed or otherwise joined to the inserts prior to insertion into the flow paths. The bracket may provide alignment and stability for the inserts during insertion. Bracket 246 includes a rear surface 248 that may be disposed on a front surface 250 of the tube. The bracket may be permanently affixed to the inserts and joined to the tube when the inserts are inserted into the flow paths. However, according to other exemplary embodiments, the bracket may be removable from the inserts after the inserts are placed within the flow paths.

FIG. 21 is a detailed perspective view of bracket 246. Bracket 246 includes grooves 252 that provide a recess for the inserts. Grooves 252 may provide stability and facilitate alignment of the inserts during placement within the flow paths. The bracket may be used with alternate insert 234 as well as with insert 222 illustrated in FIG. 18.

Figure 22:
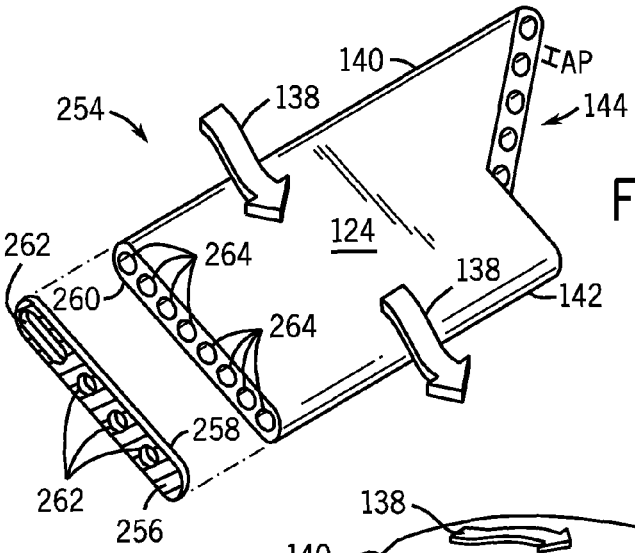
FIG. 22 is an exploded perspective view of an alternate flow control mechanism that may be employed with an exemplary multichannel tube.

FIG. 22 illustrates an alternate tube configuration 254 employing a plate 256 for varying the size of the flow paths 144 to promote flow near leading edge 140. To vary the size of flow paths 144, plate 256 may be brazed or otherwise joined to the tube in a manner that overlaps with some of the flow paths 144. A rear surface 258 of the plate may be attached to a front surface 260 of the tube. Plate 256 includes openings 262 of different sizes and spacings that vary from the size and spacing of flow path openings 264. For example, a larger opening may be placed over the tube near leading edge 140 to encircle multiple flow channels and allow flow through the entire cross-section of these flow channels while smaller openings may be placed over the tube near trailing edge 142 to overlap with flow channels and reduce the cross-sectional area for flow. As shown, plate 256 may be used with a tube that has flow paths 144 of a constant size that are spaced apart at a constant spacing AP. However, according to other exemplary embodiments, the plate may be employed with the internal tube configurations of varying spacing, cross-sections, and size, such as those illustrated in FIGS. 16 through 19. Although the plate may be inserted over either end of the tube, in a presently contemplated embodiment, the plate may be inserted over the end of the tube containing the lowest vapor quality.

Figure 23:
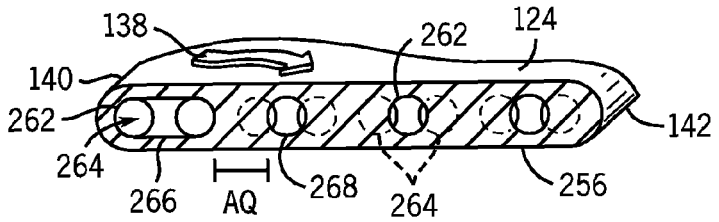
FIG. 23 is a detailed perspective view of the flow control mechanism illustrated in FIG. 22 disposed on the end of a multichannel tube.

FIG. 23 depicts tube configuration 254 with plate 256 disposed against the tube. A first opening 264 on the plate covers the first two flow paths 264 disposed closest to leading edge 140. The relatively large size of opening 264 allows the entire area of the first two flow paths to be used for flowing refrigerant within the tube near leading edge 140. Plate 256 also includes second openings 268 that do not align with individual flow path openings 264. Although second openings 268 are relatively the same size as flow path openings 264, second openings 268 are centered between openings 264 so that second openings 268 partially obstruct flow path openings 264 to reduce the cross-sectional area available for refrigerant flow. Plate openings 262, 266, and 268 are spaced apart at a distance AQ that allows plate openings 262, 266, and 268 to overlap with, but not completely align with, flow path openings 264. As shown by the dashed lines, several flow path openings 264 are partially obstructed by plate 256. The obstructed openings are located generally nearer to trailing edge 142 while the unobstructed openings are located generally nearer to leading edge 140. Consequently, the openings nearer to trailing edge 142 have a reduced cross-sectional area available for flow resulting in a tube configuration that promotes flow near leading edge 140. Although two different sizes of openings are shown in FIG. 23, the plate may have any number of openings of various sizes. For example, the plate may have openings that align directly with flow paths near the leading edge, while the openings near the trailing edge are smaller than the flow path openings.

Figure 24:
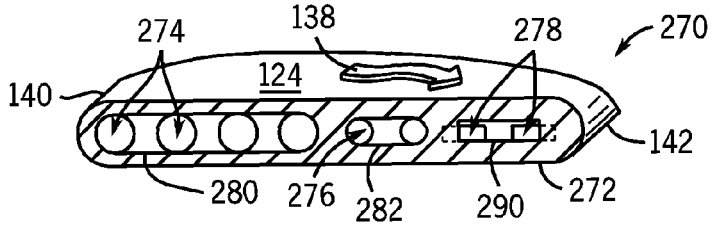
FIG. 24 is a detailed perspective view of an alternate flow control mechanism disposed on the end of a multichannel tube.

A plate also may be used to customize multichannel tubes containing flow paths configured to promote flow near the leading edge such as those shown in FIGS. 9 through 16. FIG. 24 illustrates an alternate configuration 270 where a plate 272 is used to customize a tube 124 containing flow paths 274, 276, and 278 of different sizes and cross-sections. Flow paths 274, 276 and 278 are configured to promote refrigerant flow near leading edge 140. Flow paths 274 are located near leading edge 140 and are of a circular cross-section and a relatively large size. Flow paths 276 are disposed near the middle of the tube and are also of a circular cross-section, but of a smaller size than first flow paths 274. Third flow paths 278 are located closest to trailing edge 142 and are of a rectangular shape and a relatively small size. Plate 272 includes openings 280, 282, and 290 that are configured to allow refrigerant to pass through plate 272 into flow paths 274, 276, and 278. First opening 280 is aligned to allow refrigerant to flow into the first four flow paths 274. Second opening 282 is aligned to allow refrigerant to flow into second flow paths 276. Third opening 290 is aligned to partially obstruct third flow paths 278 so that refrigerant may flow through only a portion of these flow paths. Plate openings 280, 282, and 290 are configured to promote flow near leading edge 140 by partially obstructing flow paths 274 that are located closest to trailing edge 142. According to other exemplary embodiments, the plate may contain any number of openings of various sizes and spacing configured to align with and/or partially obstruct flow paths.

Figure 25:
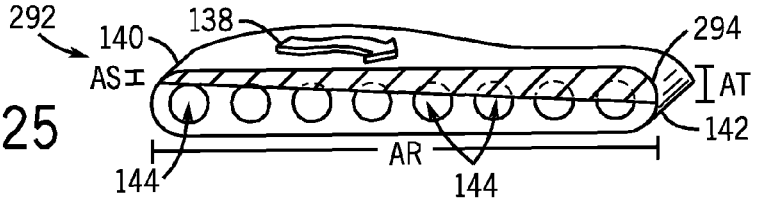
FIG. 25 is a detailed perspective view of yet another flow control mechanism disposed on the end of a multichannel tube.

FIG. 25 illustrates an alternate configuration 292 employing an alternate plate 294 designed to partially obstruct specific flow paths. Plate 294 increases progressively in height across width A from a relatively small height AS disposed near leading edge 140 and a relatively large height AT disposed near trailing edge 142. The progressively increasing height allows plate 294 to obstruct flow paths 144 by an amount that increases progressively from leading edge 140 to trailing edge 142. In this manner, the flow paths located near leading edge 140 remain partially or completely unobstructed while the flow paths located near trailing edge 142 are more obstructed to promote flow near leading edge 140. Plate 294 may be used with tubes including flow paths of a constant size, cross-section and spacing as shown in FIG. 25, as well as with tubes of various cross-sections, spacing and sizes as previously illustrated in FIGS. 9 through 16. Furthermore, heights AS and AT of the plate may vary based on the amount of obstruction required. Although plate 294 is shown in FIG. 25 as being aligned with the top of the tube, according to other exemplary embodiments, the plate may be aligned with the bottom of the tube.

Figure 26:
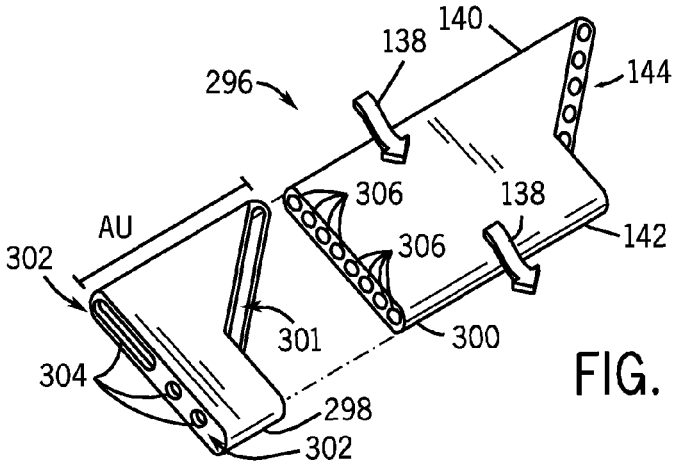
FIG. 26 is an exploded perspective view of an alternate flow control mechanism that may encapsulate the end of a multichannel tube.

FIG. 26 illustrates an alternate configuration 296 that may be used to promote fluid flow near leading edge 140. Instead of a plate as shown in FIGS. 22 through 25, a sleeve 298 may be placed over an end 300 of the tube. Sleeve 298 encapsulates an outer portion of the tube and may provide additional stability and a solid joint between sleeve 298 and the tube. Sleeve 298 includes an interior volume 301 that may be hollow to allow sleeve 298 to enclose the outside of the tube. A front surface 302 may contain openings 304 that allow flow of refrigerant through sleeve 298 and into flow path openings 306 contained within the tube. Sleeve openings 304 may be configured to align with and partially obstruct some of the flow path openings 306 to promote flow near leading edge 140. Sleeve 298 includes a length AU that determines the amount of overlap between sleeve 298 and the tube. For example, as length AU increases, sleeve 298 will encapsulate more of the tube. Length AU may vary depending on the support needed for the sleeve. The sleeve may be constructed of aluminum or other suitable material and may be placed loosely over the tube or brazed or joined to the tube. Front surface 302 may contain openings of various configurations such as those illustrated by the plates shown in FIGS. 22 through 25. According to certain exemplary embodiments, the openings may be of varying cross-sections, spacings, and sizes to promote fluid flow near the leading edge.

FIGS. 27 and 28 illustrate alternate configurations for promoting flow near the leading edge where sections of the tube operate as flow control mechanisms. FIG. 27 illustrates an alternate tube 308 containing a crimped section 310. In crimped section 310, indentations 312 have been made into flow paths 144 to convert the flow paths from original flow paths 314 into crimped flow paths 316. The tube includes original flow paths 314 located near leading edge 140 that have a square cross-section. Crimped flow paths 316 are located near trailing edge 142 and include indentations 312 that create a bow-tie shaped cross-section. The bow-tie shaped cross section provides a smaller cross-section and flow area for crimped flow paths 316 than for original flow paths 314. The smaller cross-section and flow area are designed to promote more refrigerant flow within original flow paths 314, which are nearer to leading edge 140. The bow-tie shaped cross-section extends through tube for a length AV. According to certain exemplary embodiments, length AV may extend the entire length of the tube. However, according to other exemplary embodiments, length AV may extend for only a portion of the tube. In a presently contemplated embodiment, length AV may extend within a portion of the tube near the low vapor quality end of the tube. As may be appreciated, the low vapor quality end of the tube may vary depending on whether the tube is located in a heat exchanger functioning as an evaporator or as a condenser. For example, in an evaporator, the inlet side of the tube contains the most liquid and thus the lowest vapor quality. Therefore, in an evaporator, the length AV may extend near the inlet side of the tube. In a condenser, the outlet side of the tube contains the most liquid, and therefore has the lowest vapor quality. As a result, in a condenser, the length AV may extend near the outlet side of the tube.

The crimped section may be produced during manufacturing of the tube, or an existing tube may be modified by crimping to customize a tube already manufactured and/or contained within a heat exchanger. The crimped section may be formed using a tool, such as die press or the like, to produce indentations within the flow paths. The angle of the indentations may vary depending on the size reduction required to promote flow near the leading edge.

FIG. 28 depicts an alternate tube 318 containing a crushed section 320 that promotes flow near leading edge 140. Tube 318 includes original flow paths 322 and crushed flow paths 324 contained within a crushed section 320. Original flow paths 322 have a larger cross-section than the crushed flow paths 324. In crushed section 320, a portion of the tube extending for a length AW has been pressed or flattened to reduce the size of crushed flow paths 324. According to certain exemplary embodiments, the crushed section may extend the entire length of the tube; while according to other exemplary embodiments, the crushed section may extend for a length AW located hear the low vapor quality end of the tube. Crushed section 320 functions to reduce the height of the tube from the unmodified height AY to a reduced height AZ. Reduced height AZ may vary depending on the individual properties of the heat exchanger. The width AX that has been crushed may vary depending on the desired number of crushed openings 324. Crushed section 320 produces crushed flow paths 324 that become increasingly smaller in size as they approach the trailing edge 142, and is intended to concentrate flow near leading edge 140.

Any combination of tube configurations may be used in accordance with the present techniques to promote flow near the leading edge of a tube. For example, tubes may contain flow paths of various sizes, cross-sections, and spacings as illustrated in FIGS. 9 through 16. These tubes may be further modified by using inserts or blocking plates or sleeves shown in FIGS. 17 through 26. According to certain exemplary embodiments, tubes containing flow paths of a constant size and spacing, such as the tube illustrated in FIG. 22, may be modified by a blocking plate or sleeve as illustrated in FIGS. 22 through 26. According to other exemplary embodiments, tubes of a constant cross-section and spacing may be crimped or crushed to provide a flow control mechanism contained within a section of the tube. The modifications performed on the tube or the configurations employed may vary depending on the individual properties of the heat exchanger.

The tube configurations described in FIGS. 9 through 28 may find application in a variety of heat exchangers and HVAC&R systems containing heat exchangers. However, the configurations are particularly well-suited to heat exchangers functioning as evaporators and/or condensers where the temperature difference between the refrigerant and the external fluid is much greater at the leading edge of the tubes than at the trailing edge of the tubes. The tube configurations are intended to promote flow of refrigerant near the leading edge to capitalize on the large temperature difference that may exist near the leading edge.

It should be noted that the present discussion makes use of the term "multichannel" tubes or "multichannel heat exchanger" to refer to arrangements in which heat transfer tubes include a plurality of flow paths between manifolds that distribute flow to and collect flow from the tubes. A number of other terms may be used in the art for similar arrangements. Such alternative terms might include "microchannel" and "microport." The term "microchannel" sometimes carries the connotation of tubes having fluid passages on the order of a micrometer and less. However, in the present context such terms are not intended to have any particular higher or lower dimensional threshold. Rather, the term "multichannel" used to describe and claim embodiments herein is intended to cover all such sizes. Other terms sometimes used in the art include "parallel flow" and "brazed aluminum". However, all such arrangements and structures are intended to be included within the scope of the term "multichannel." In general, such "multichannel" tubes will include flow paths disposed along the width or in a plane of a generally flat, planar tube, although, again, the invention is not intended to be limited to any particular geometry unless otherwise specified in the appended claims.

While only certain features and embodiments of the invention have been illustrated and described, many modifications and changes may occur to those skilled in the art (e.g., variations in sizes, dimensions, structures, shapes and proportions of the various elements, values of parameters (e.g., temperatures, pressures, etc.), mounting arrangements, use of materials, colors, orientations, etc.) without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the invention. Furthermore, in an effort to provide a concise description of the exemplary embodiments, all features of an actual implementation may not have been described (i.e., those unrelated to the presently contemplated best mode of carrying out the invention, or those unrelated to enabling the claimed invention). It should be appreciated that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The invention claimed is:

1. A heat exchanger comprising: a first manifold; a second manifold; a plurality of multichannel tubes extending lengthwise between and in fluid communication with the first and second manifolds, the plurality of multichannel tubes being configured to receive an external fluid flowing across the width of each multichannel tube from a leading edge to a trailing edge and configured to flow an internal fluid along the length of each multichannel tube such that the internal fluid exchanges heat with the external fluid and a vapor quality of the internal fluid changes as it progresses along the length; a plurality of generally parallel flow paths disposed within each multichannel tube and extending lengthwise through each multichannel tube; and a flow control mechanism included within at least one multichannel tube, the flow control mechanism being configured to allow more of the internal fluid to flow near the leading edge than near the trailing edge of the at least one multichannel tube, wherein the flow control mechanism includes a crimped flow path disposed near the trailing edge and an uncrimped flow path disposed near the leading edge.

2. The heat exchanger of claim 1, wherein the crimped flow path has a uniform cross-section across the length of the at least one multichannel tube.

3. The heat exchanger of claim 1, wherein the flow control mechanism includes a crushed flow path disposed near the trailing edge and an uncrushed flow path disposed near the leading edge.

4. The heat exchanger of claim 1, wherein the flow control mechanism disposed near a lengthwise end of the at least one multichannel tube containing the internal fluid with a lower vapor quality relative to an opposite lengthwise end of the at least one multichannel tube.

5. A heat exchanger comprising: a first manifold; a second manifold; a plurality of multichannel tubes in fluid communication with the first and second manifolds, the plurality of multichannel tubes being configured to receive an external fluid flowing across a width dimension extending from a leading edge to a trailing edge; a plurality of generally parallel flow paths disposed within each of the plurality of multichannel tubes extending lengthwise through each of the plurality of multichannel tubes, each flow path being configured to flow an internal fluid such that the internal fluid exchanges heat with the external fluid and a vapor quality of the internal fluid changes as it progresses lengthwise through each of the plurality of multichannel tubes; a first flow path of the plurality of generally parallel flow paths disposed near the leading edge; a second flow path disposed near the trailing edge; and a crimp in the second flow path disposed near an end of the second flow path containing the internal fluid with a lowest vapor quality relative to other portions of the second flow path, wherein the crimp is configured to manage flow by reducing the size of the second flow path such that the second flow path is smaller than the first flow path.

6. The heat exchanger of claim 5, wherein the first flow path has a uniform cross-section across the length of the first flow path.

7. The heat exchanger of claim 5, comprising fins disposed between the plurality of multichannel tubes.

8. The heat exchanger of claim 5, wherein the plurality of generally parallel flow paths is configured to allow more of the internal fluid to flow within each of the plurality of multichannel tubes near the leading edge relative to an amount flowing near the trailing edge.

9. A heat exchanger comprising: a first manifold; a second manifold; a plurality of multichannel tubes in fluid communication with the first and second manifolds, the plurality of multichannel tubes being configured to receive an external fluid flowing across a width dimension extending from a leading edge to a trailing edge; a plurality of generally parallel flow paths disposed within each of the plurality of multichannel tubes and extending lengthwise through each of the plurality of multichannel tubes, wherein a distance between each of the plurality of generally parallel flow paths increases along the width dimension from the leading edge to the trailing edge; a first flow path disposed near the leading edge of a first multichannel tube of the plurality of multichannel tubes; and a second flow path disposed near the trailing edge of the first multichannel tube, the second flow path having an opening that is partially obstructed by a flow control mechanism to reduce a size of the opening such that the second flow path is smaller than the first flow path, wherein the flow control mechanism includes a crimped flow path.

* * * * *